United States Patent [19]

Schwartz et al.

[11] Patent Number: 4,610,349

[45] Date of Patent: Sep. 9, 1986

[54] FOUR-PACK BOTTLE CARRIER

[75] Inventors: Arthur Schwartz, Amherst; Paul O. Scott, Buffalo, both of N.Y.

[73] Assignee: Wagner Folding Box Corp., Buffalo, N.Y.

[21] Appl. No.: 734,032

[22] Filed: May 14, 1985

[51] Int. Cl.[4] ..... R65D 75/00

[52] U.S. Cl. ..... 206/175; 206/163; 206/170; 206/180; 229/41 B; 229/52 BC

[58] Field of Search ..... 206/143, 147, 157, 175, 206/180, 186, 188, 191, 197, 427, 434, 163, 170; 229/28 BC, 52 BC, 41 B

[56] References Cited

U.S. PATENT DOCUMENTS

| | | | |
|---|---|---|---|
| 2,543,821 | 3/1951 | Arneson | 206/180 |
| 2,675,157 | 4/1954 | Turner et al. | 206/143 |
| 2,733,832 | 2/1956 | Newton . | |
| 2,755,964 | 7/1956 | Ringler . | |
| 2,763,398 | 9/1956 | Moore | 229/52 BC |
| 2,794,571 | 6/1957 | Fielding . | |
| 2,808,177 | 10/1957 | Buttery . | |
| 2,821,328 | 1/1958 | Ramsay . | |
| 2,860,816 | 11/1958 | Fielding . | |
| 2,881,946 | 4/1959 | Bosrock et al. . | |
| 2,991,908 | 7/1961 | Conescu . | |
| 3,191,800 | 6/1965 | Kowal | 229/28 BC |
| 3,365,098 | 1/1968 | Sims | 206/188 |
| 3,446,414 | 5/1969 | Omori | 206/180 |
| 4,318,470 | 3/1982 | Montealegre . | |
| 4,378,880 | 4/1983 | Summers . | |
| 4,402,400 | 9/1983 | Stout | 229/28 BC |
| 4,509,640 | 4/1985 | Joyce | 206/175 |

FOREIGN PATENT DOCUMENTS

| | | | |
|---|---|---|---|
| 576178 | 5/1959 | Canada | 206/175 |
| 599749 | 6/1960 | Canada | 206/175 |

*Primary Examiner*—Joseph Man-Fu Moy
*Assistant Examiner*—David Fidei
*Attorney, Agent, or Firm*—Christel, Bean & Linihan

[57] ABSTRACT

A four-pack bottle carrier requiring minimal gluing and materials, which can be readily glued up with existing machinery, which will lie flat after gluing and prior to erection, and which can be folded flat again after use. The carrier which is formed from a single piece of paperboard includes four side panels (12, 14, 16, 18) of substantially equal width, a side glue flap (26), and two pairs of opposed bottom panels (66, 68 and 80, 82). The upper portion of the side panels are provided with suitable die cuts (34, 36, 38, 40, 42) and cutouts (56, 62, 64) which facilitate the forming of the bottle dividers (94, 96) and a combined handle and bottle dividers when the bottle carrier is glued up and erected.

5 Claims, 8 Drawing Figures

Fig. 8.
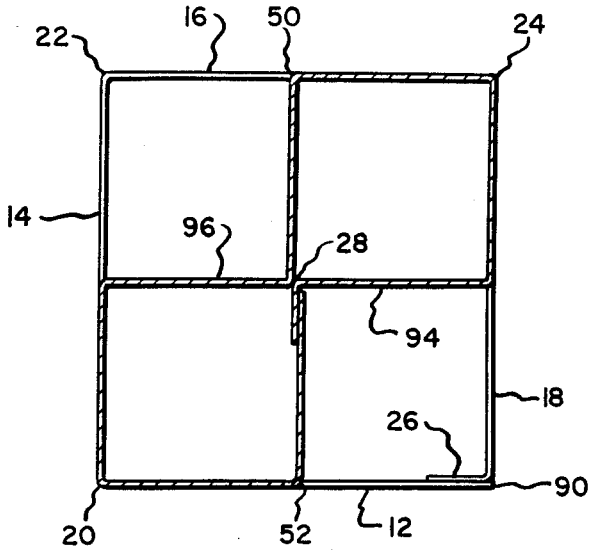
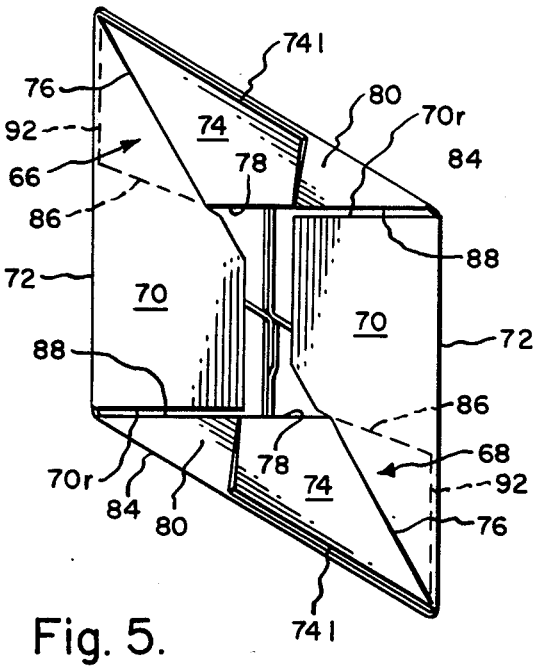
Fig. 5.
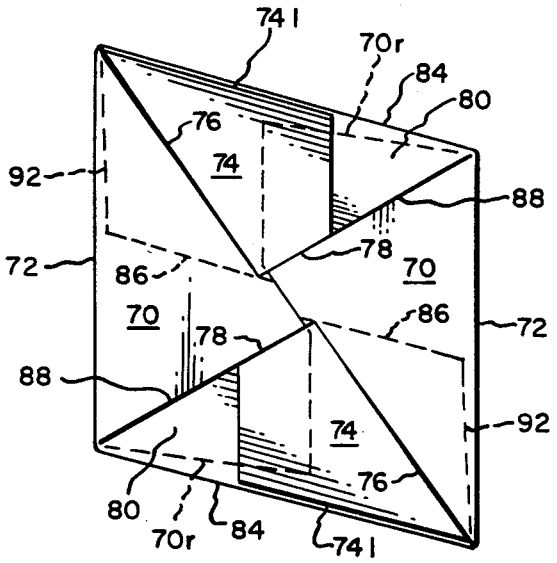
Fig. 6.
Fig. 7.
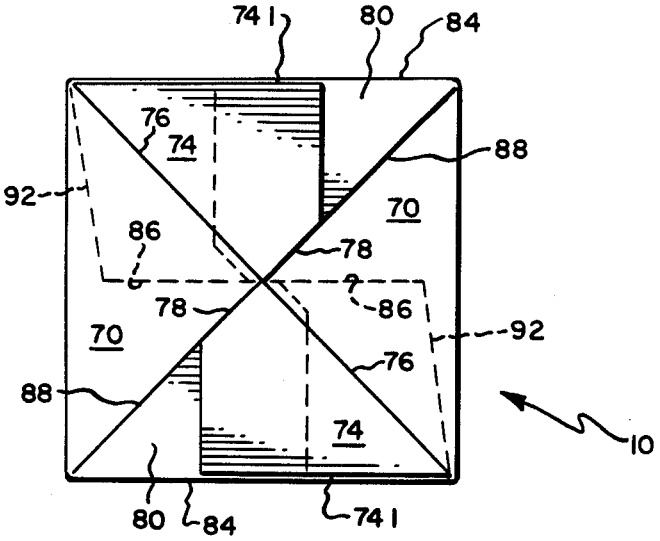

FOUR-PACK BOTTLE CARRIER

TECHNICAL FIELD

The present invention relates generally to bottle carriers and more specifically to an improved four-pack bottle carrier requiring minimal gluing and materials, which can be readily glued up with existing machinery, which will lie flat after gluing and prior to erection, and which can be folded flat again after use, the four-pack bottle carrier being formed from a single piece paperboard structure.

BACKGROUND OF THE INVENTION

Four and six-pack bottle carriers are well-known in the art and typical examples are U.S. Pat. No. 2,733,832 issued Feb. 7, 1956 to Newton; U.S. Pat. No. 2,860,816 issued Nov. 18, 1958 to Fielding; U.S. Pat. No. 2,991,908 issued July 11, 1961 to Conescu; U.S. Pat. No. 3,446,414 issued May 27, 1969 to Omori and U.S. Pat. No. 4,318,470 issued Mar. 9, 1982 to Montealegre.

OBJECTS AND SUMMARY OF THE PRESENT INVENTION

It is an object of the present invention to provide a novel four-pack bottle carrier of lower cost than prior designs, more specifically, it is an object of the present invention to provide a novel four-pack bottle carrier requiring less paperboard than other known prior art constructions.

It is a further object of the present invention to provide a four-pack bottle carrier which requires minimal gluing, which will lie flat after gluing and prior to erection, which can be readily glued up with existing machinery, and which can be folded flat again after use.

The foregoing objects and other objects and advantages of the present inventon will be more fully understood after a consideration of the following detailed description taken in conjunction with the accompanying drawings in which a preferred form of the present invention is illustrated.

BRIEF DESCRIPTION OF THE FIGURES

FIG. 5 is a bottom view of the four-pack bottle carrier of this invention showing the configuration of the bottom panels when partially erected.

FIG. 6 is a view similar to FIG. 5 but showing the bottom panels when further erected.

FIG. 7 is a view similar to FIGS. 5 and 6 but showing the bottom panels when the four-pack bottle carrier of the present invention is fully erected.

FIG. 8 is a sectional view taken generally along the line 8—8 in FIG. 2.

DETAILED DESCRIPTION

Figure 1:
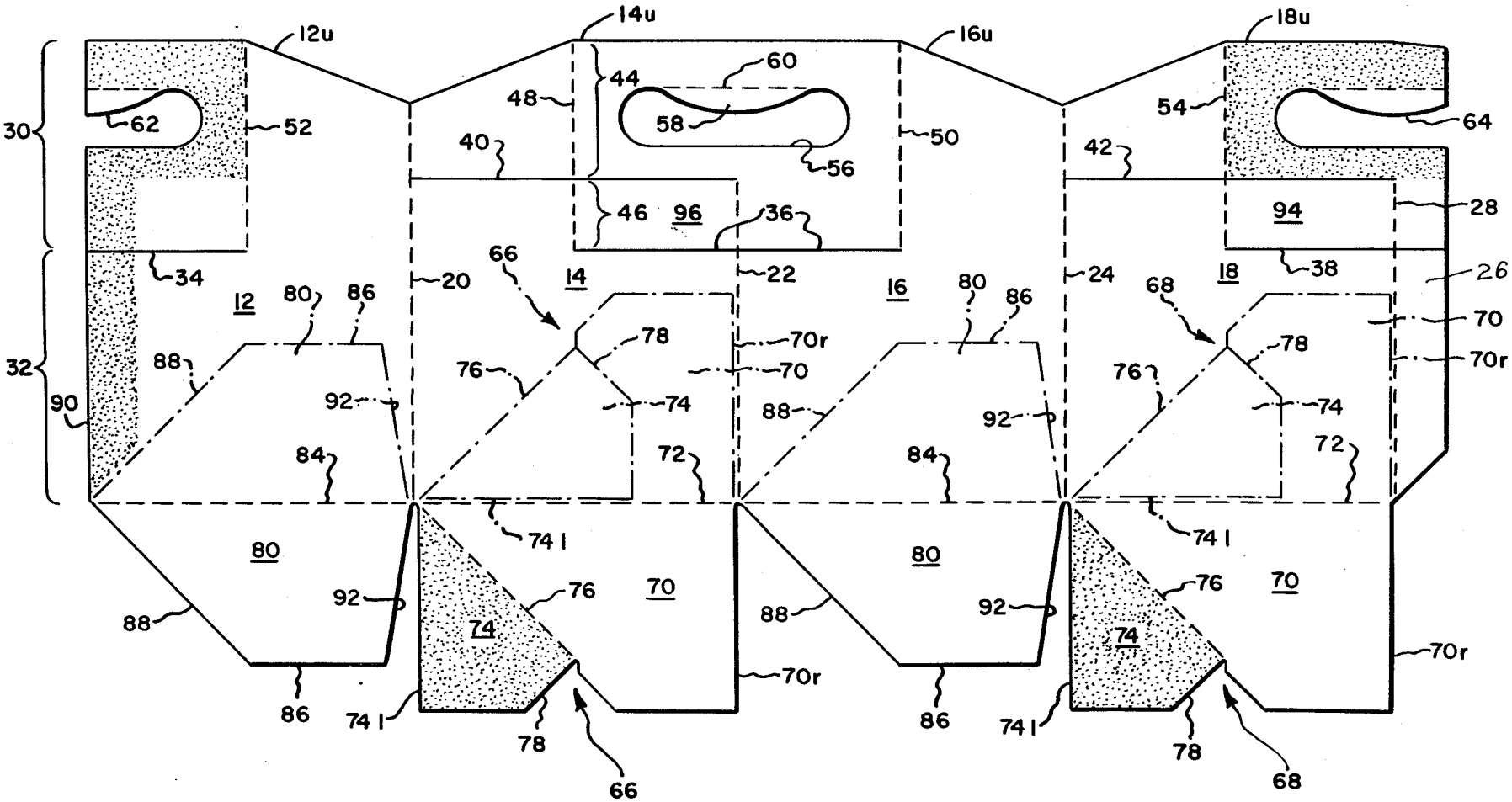
FIG. 1 is a view showing the paperboard blank from which the four-pack bottle carrier of the present invention can be made, glue being applied to the surfaces indicated by stippling in this figure.
Figure 2:
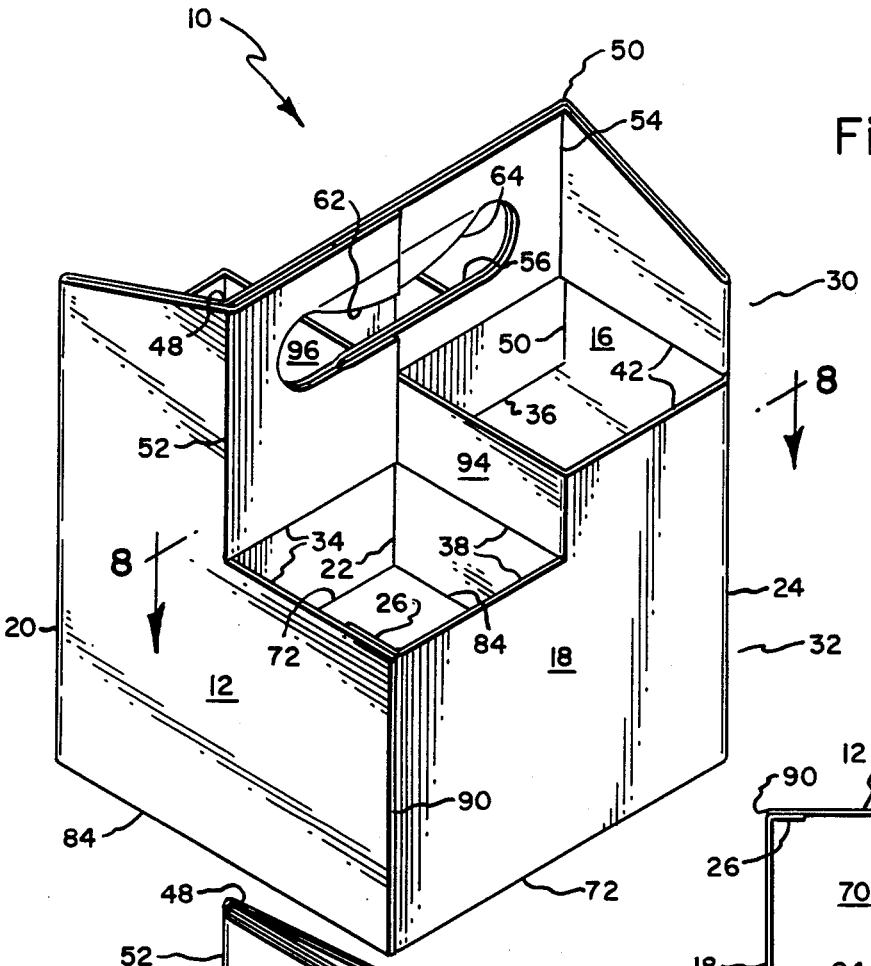
FIG. 2 is a perspective view illustrating the four-pack bottle carrier when fully erected in the position that it would assume when carrying four bottles.
Figure 4:
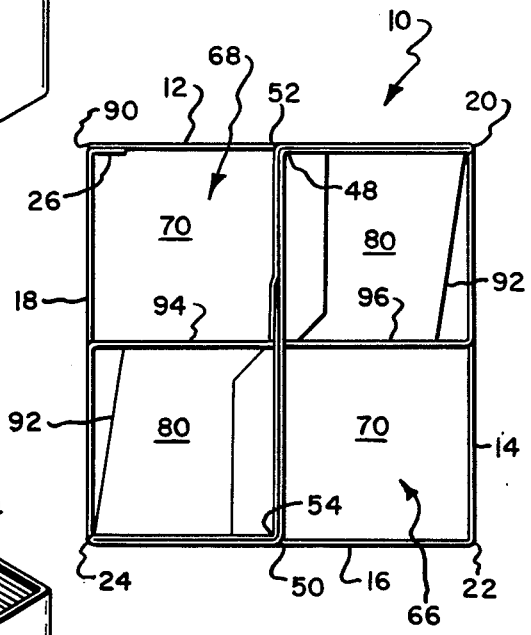
FIG. 4 is a top view of the bottle carrier shown in FIGS. 2 and 3.
Figure 3:
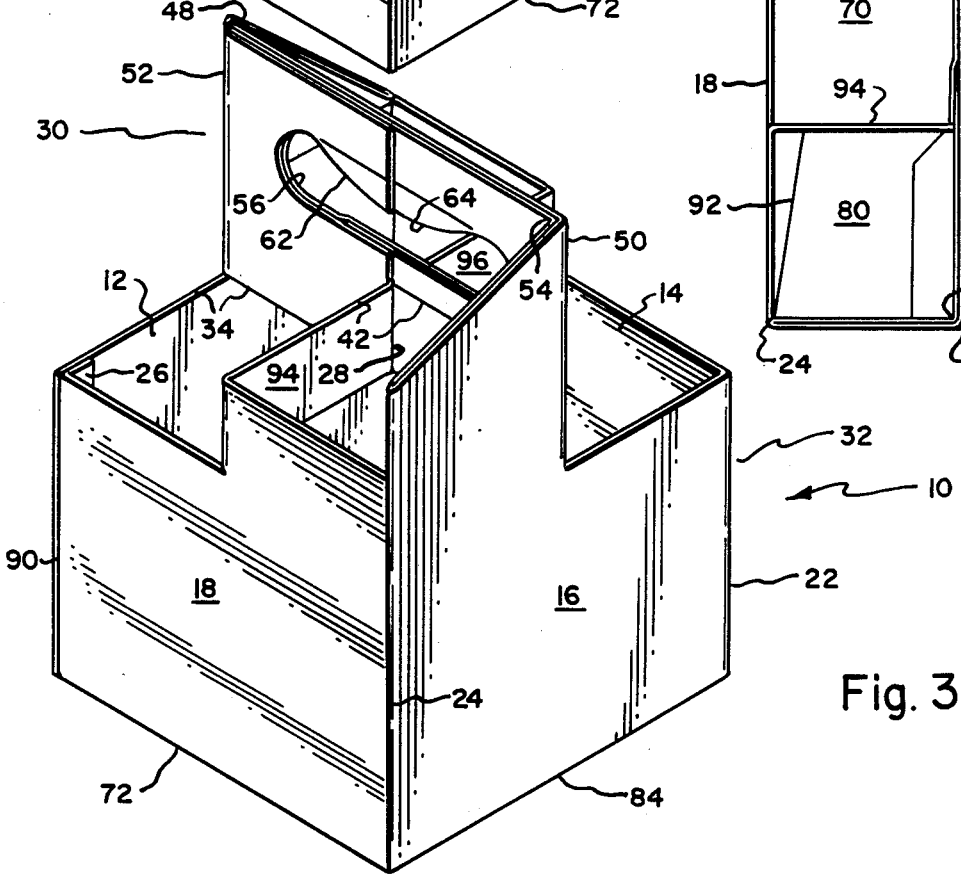
FIG. 3 is a view similar to FIG. 2 but rotated 90°.

Referring to the various figures, it can be seen that the four-pack bottle carrier of this inventon, which is indicated generally at 10, consists of a variety of panels.

Thus, there are four side panels 12, 14, 16 and 18 which all have substantially the same width. When the carrier is erected, panels 14 and 18 will form a first pair of substantially identical side panels, and similarly panels 12 and 16 will form a second pair of substantially identical side panels. It can be seen that adjacent side panels are connected to each other by vertical fold lines. Thus, as viewed in FIG. 1, the left-hand side panel 12 is connected to left center side panel 14 by fold line 20. Similarly, the left center panel 14 is connected to the right center panel 16 by fold line 22 and panel 16 is connected to the right-hand panel 18 by fold line 24. Fold lines 20 and 24 are substantially identical in length. However, fold line 22 does not extend all the way to the upper marginal edge of panels 14 and 16, the upper edges of the side panels being indicated at 12*u*, 14*u*, 16*u* and 18*u*. In addition to the various side panels 12, 14, 16 and 18, there is also a glue flap 26 disposed along side of the right hand side panel 18, this flap also being connected by a fold line 28 of the same length as the fold line 22. Each of the side panels is divided into upper and lower portions which are indicated by the brackets 30, 32, respectively. Thus, the left-hand side panel 12 is divided into upper and lower portions by a lower horizontal die cut 34. The left center panel 14 and right center panel 16 are divided into upper and lower portions by a lower horizontal die cut 36. Finally, the right-hand panel 18 and glue flap are divided into upper and lower portions by lower horizontal die cut 38. Each of the die cuts 34, 36, 38 extends horizontally halfway through the width of its associated side panel. The upper portion of the first pair of side panels 14, 18 is further provided with a full width upper horizontal die cut 40, 42, which divides the upper portion 30 of each of the first pair of side panels 14, 18 into a topmost upper portion, indicated by bracket 44, and another upper portion 46. Each of the first pair of opposed side panels 14, 18 is further provided with an intermediate vertical fold line 48, 50, respectively, which is disposed substantially midway between the sides of the side panel and extends from one end to the associated lower horizontal die cut 36 or 38 to the upper marginal edge 14*u*, 18*u* of the upper portion. The second pair of side panels is also provided with intermediate vertical fold lines, there being a fold line 52 associated with panel 12 and intermediate vertical fold line 54 associated with panel 16. These fold lines also extend from one end of an associated die cut 34 or 36 to the upper marginal edge 12*u* or 18*u*.

Disposed above an intermediate portion of the lower horizontal die cut 36 in the topmost upper portion of panels 14, 16 is a kidney-shaped handle forming cutout 56, there being an upper depending portion or flap 58 divided from the topmost upper portion by a further horizontal fold line 60. The flap can be folded back to provide a comfortable carrying surface for the hand. Panels 12 and 18 are also provided with cutouts 62, 64 which conform, at least in part, to the kidney shaped cutout so that when these parts are glued up, the handle carrying portion will be reinforced.

The four-pack bottle carrier of this invention further includes two pairs of opposed bottom panels, the first pair of opposed bottom panels, indicated generally at 66, 68, each including a first portion 70 connected to an adjacent side panel by a horizontal fold line 72. Each of the first pair of opposed bottom panels further includes a triangular glue flap 74 which is secured to the first portion by another fold line 76. As can best be seen from FIG. 1, the fold line 76 extends at an angle of approximately 45° from the intersection of the horizontal fold line 72 with a vertical fold line 20 or 24. The triangular glue flaps 74 are notched along line 78 to facilitate the erection of the four-pack bottle carrier. It should be noted that the distance from the intersection of the line 78 and the fold line 76 from the horizontal fold line 72 is approximately ½ the width of the side panels. Similarly, the distance from the intersection of line 78 and line 76 to the side edges 701 and **74*r*** is also approximately ½ the width of the side panels.

The four-pack bottle carrier is further provided with a second pair of substantially identical opposed bottom panels 80, 80. Each of these panels is interconnected with an adjacent side panel by a horizontal fold line 84. Each panel further has an opposed marginal edge 86 which is parallel to the fold line 84 and is spaced away from the fold line 84 by a distance approximately equal to ½ the width of the side panels. Two other marginal edges are provided, the direction one of the marginal 88 extending at approximately a 45° angle from the intersection of the horizontal fold line 84 and either the associated vertical fold line 22 or the vertical edge 90. The final marginal edge 92 extends away from the intersection of the horizontal fold line 84 and the associated vertical fold line at an angle slightly less than a right angle.

The blank from which the bottle carrier is made is shown in FIG. 1. This blank is formed from a single piece of paperboard and is die cut scored and otherwise provided with suitable fold lines in the manner indicated in the figure. Glue can be applied to the various areas indicated by stippling and the bottle carrier can then be assembled. In this connection, the bottom flaps are folded up onto the side flaps, and simultaneously the triangular glue flaps 74 are folded down onto the backs of the flaps 70 as shown in phantom lines in FIG. 1. (While the glue is not shown on the triangular flap in phantom, it would face the viewer.) The right-hand side panel 18, glue flap 26, and bottom panel 68 are then folded onto the right middle side panel and bottom panel 62 to secure these parts together. Finally, the left-hand side panel 12 and bottom panel 80 are folded along line 20 onto the left center side panel 14, bottom panel 66 and glue flap 26 to secure these parts together and to complete the gluing process. At the completion of the gluing process, the bottle carrier will have a flat form which in outline corresponds to vertical fold line 20, horizontal fold lines 72 and 84, vertical fold line 24 and upper marginal edges **16*u* and 14*u*. The carrier can now be opened up from its flat condition which will cause the bottom to descend initially to the position in FIG. 5 and then to the position shown in FIG. 6. When bottles are placed into the carrier the bottom will then conform to the position shown in FIG. 7. During the erection process, the intermediate panel portion 94 between die cuts 38 and 42 will form one bottle divider and the other intermediate panel portion 96 will form an opposed bottle divider. The glued up upper portions which remain in the plane of the cutout 56** will also form another bottle divider along with the handle portion.

While a preferred structure in which the principles of the present invention has been incorporated is shown and described above, it is to be understood that the invention is not to be limited to the particular details shown and described above, but that, in fact, widely differing means may be employed in the practice of the broader aspects of this invention.

What is claimed is:

1. A four pack bottle carrier requiring minimal gluing and materials, which can be readily glued up with existing machinery, which will lie flat after gluing and prior to erection, and which can be folded flat again after use; said carrier comprising a single piece paperboard structure having:

four side panels of substantially equal width, adjacent side panels being connected to each other by vertical fold line, each of the side panels consisting of upper and lower portions, the upper portions being divided from the lower portions by lower horizontal die cuts each of which extends horizontally only halfway through the width of an associated side panel, the upper portion of a first pair of opposed side panels being further provided with a full width upper horizontal die cut which divides the upper portion of each of the first pair of side panels into a top portion and an intermediate portion, the top portion above the full width die cut being glued to the upper portion of an adjacent one of a second pair of opposed side panels, and the intermediate portion between the lower and upper horizontal die cuts on said first pair of opposed side panels forming a bottle divider along with the glued top portion when the carrier is erected;

a glue flap to one side of one of said panels; and two pairs of opposed bottom panels, the first pair of opposed bottom panels including a first portion connected to an adjacent side panel by a horizontal fold line, and a triangular glue flap secured to the first portion by another fold line, the triangular glue flap being glued to an adjacent bottom panel of the second pair of bottom panels.

2. The four pack bottle carrier as set forth in claim 1 in which said another fold line intersects the junction of an adjacent horizontal fold line and a vertical fold line.

3. The four pack bottle carrier as set forth in claim 1 in which the top portion of the upper portion of each of the first pair of opposed side panels is provided with a handle forming cutout disposed above the upper horizontal die cuts, and in which the upper portion of each of the second pair of opposed side panels is also provided with a handle forming cutout in horizontal alignment with the handle forming cutouts of the first pair of opposed side panels.

4. The four pack bottle carrier as set forth in claim 1 in which the first pair of opposed side panels is provided with an intermediate vertical fold line extending from one end of the lower horizontal die cut to the upper marginal edge of the upper portion, the intermediate vertical fold line being disposed substantially midway between the sides of the side panel.

5. The four pack bottle carrier as set forth in claim 4 in which the second pair of opposed side panels is provided with an intermediate vertical fold line extending from one end of the lower horizontal die cut to the upper marginal edge of the upper portion, the intermediate vertical fold line being disposed substantially midway between the sides of the side panel.

* * * * *